US005292028A

United States Patent [19]

Patterson et al.

[11] Patent Number: 5,292,028

[45] Date of Patent: Mar. 8, 1994

[54] PLATE-AND-GLASS ASSEMBLIES (III)

[76] Inventors: Ronald Patterson, 11 Bd Albert-1er, Monte-Carlo, Monaco; John W. Patterson, 20819 229th Ave. SE., Maple Valley, Wash. 98038

[21] Appl. No.: 967,257

[22] Filed: Oct. 26, 1992

Related U.S. Application Data

[63] Continuation-in-part of Ser. No. 870,392, Apr. 17, 1992, abandoned, which is a continuation-in-part of Ser. No. 832,436, Feb. 7, 1992, Pat. No. 5,176,283.

[51] Int. Cl.[5] ..... B65D 21/02

[52] U.S. Cl. ..... 220/574; 220/23.86; 206/217; 206/541

[58] Field of Search ..... 220/23.83, 23.86, 574; 206/217, 541

[56] References Cited

U.S. PATENT DOCUMENTS

| | | | |
|---|---|---|---|
| D. 211,532 | 6/1968 | Ashton . | |
| 1,187,899 | 6/1916 | Gardam | 220/23.86 |
| 1,688,992 | 10/1928 | Smith . | |
| 2,240,020 | 4/1941 | Raiser . | |
| 2,565,912 | 8/1951 | Davis . | |
| 2,920,804 | 1/1960 | Minton . | |
| 3,955,672 | 5/1976 | Brundage | 220/23.86 X |
| 4,461,396 | 7/1984 | Harper . | |
| 4,534,469 | 8/1985 | Elsmo | 206/217 X |
| 4,823,958 | 4/1989 | Mahmud | 220/23.83 |
| 4,867,331 | 9/1989 | Task | 220/23.83 |
| 4,927,024 | 5/1990 | Lloyd | 220/23.86 |
| 4,938,373 | 7/1990 | McKee | 220/23.86 |
| 4,989,742 | 2/1991 | Powell | 220/23.83 X |
| 5,058,737 | 10/1991 | Patterson et al. | 220/23.86 X |
| 5,060,820 | 10/1991 | Boerner | 220/23.83 X |
| 5,085,391 | 2/1992 | Berger et al. | 220/23.83 X |
| 5,110,170 | 5/1992 | Boatwright | 220/23.83 X |
| 5,207,743 | 5/1993 | Costarella et al. | 220/574 |

*Primary Examiner*—Steven M. Pollard
*Attorney, Agent, or Firm*—Hughes & Multer

[57] ABSTRACT

Plate-and-glass assemblies which include a plate, a beverage container detachably assembled to the plate, and a glass holder which is attached to or formed on the bottom of the plate to hold that component and the glass together. The beverage container may be a commonly available beverage can. Separate caps may be provided for adapting any number of beverage container styles to fit a generic glass holder. A radially extending slot may be provided on the cap through which a straw may be provided to facilitate drinking of the beverage in the container. Nested cans may be provided for additional insulation of the beverage. Indicia on the upper, food-receiving surface of the plate facilitate the assembling of the glass to the plate; and an optional drinking straw port provides a convenient way of locking the plate and glass together and also makes it possible to reach the contents of the glass without removing the plate. The glass holder may comprise rails which accommodate beverage cans having rims with two or more different diameters.

19 Claims, 12 Drawing Sheets

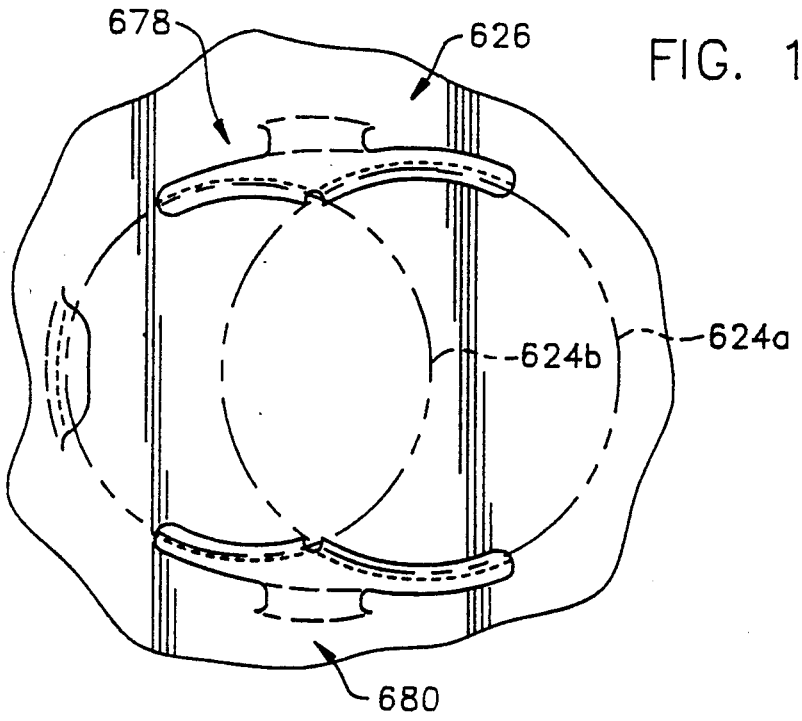
FIG. 16
FIG. 18
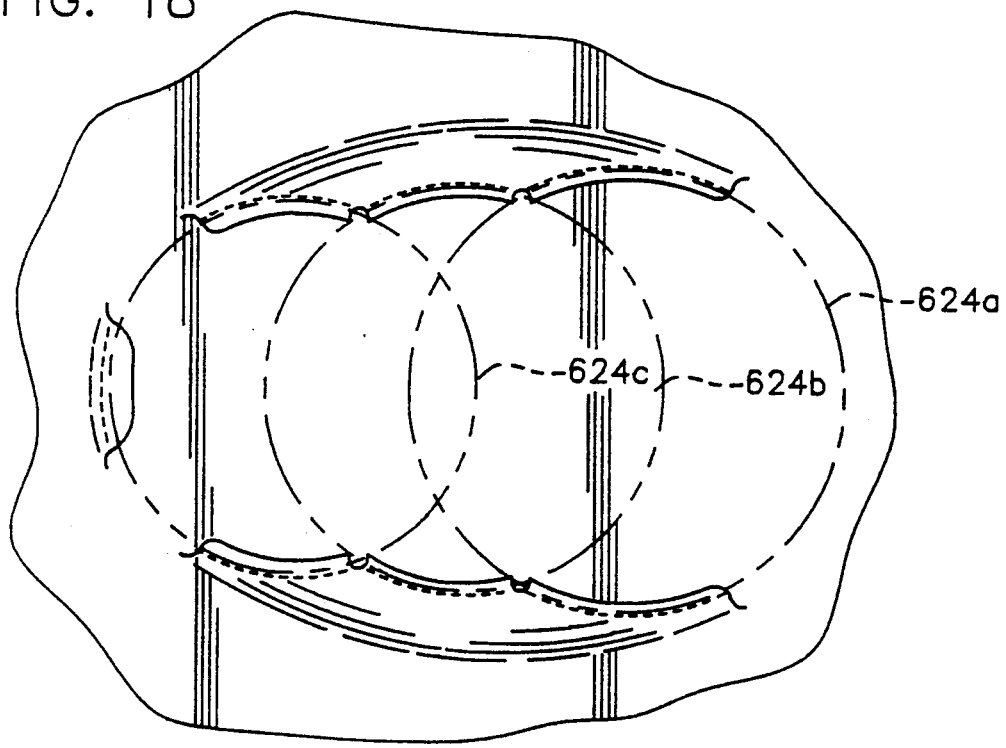

PLATE-AND-GLASS ASSEMBLIES (III)

RELATION TO OTHER APPLICATIONS

This application is a continuation-in-part of U.S. patent application Ser. No. 07/870,392 filed Apr. 17, 1992 for PLATE-AND-GLASS ASSEMBLIES (II) now abandoned, which itself is a continuation-in-part of U.S. patent application Ser. No. 07/832,436 filed Feb. 17, 1992 for PLATE-AND-GLASS ASSEMBLIES, now U.S. Pat. No. 5,176,283.

TECHNICAL FIELD OF THE INVENTION

The present invention relates to plates and glasses for serving food and drink. More particularly, the present invention relates to novel, improved assemblies of a plate and a glass which is attachable to the plate to form a unit which can be handled with one hand and to components for such assemblies.

The terms "plate" and "glass" are employed herein in a broad, generic sense. The term "plate" is intended to embrace such diverse artifacts as individual eating dishes and different types of serving dishes. "Glass" encompasses containers conventionally named by that term, beverage and soup cups, etc.

BACKGROUND OF THE INVENTION

A number of situations exist in which the use of conventional plates and glasses is difficult. For example, at parties, picnics, and other social gatherings, guests are often obligated to stand or walk about while eating and drinking. Inevitably, they are forced to hold their plate in one hand and their glass in the other. This does not leave free a hand with which to eat. Therefore, the guest must first seek out a resting place for at least the glass. Not only is this inconvenient, but the availability of suitable resting places is frequently quite limited at a social gathering. Furthermore, a guest may be unable to subsequently identify his drink and may recover another's drink by mistake. It is also frequently difficult to carry a separate plate and glass through a buffet line or when returning to one's seat at a sporting event or movie theater.

Several different assemblies for eliminating the need to use both hands to carry a plate and a glass have been proposed. One such assembly is shown in U.S. Pat. No. 2,240,020 issued Apr. 29, 1941 to Raiser. That assembly includes a plate having a central aperture for a cup and a hollow handle which extends downwardly from the cup-receiving receptacle. Although this device permits one to carry both the plate and cup with one hand, the cup is not actually attached to the plate and is thus easily dislodged or overturned. Furthermore, liquid can readily slosh over the open top of the cup and onto the food. Still further, the food on the plate can easily come into contact with and foul the exterior of the drinking cup; and food may slosh through the opening in the plate and pass through the hollow handle onto an underlying table or lap.

U.S. Pat. No. 2,920,804 issued Jan. 12, 1960 to Minton discloses a somewhat similar assembly in which a hollow sleeve forms a receptacle for a glass. This sleeve is joined to a plate component by a bead which releasably engages a flange on the plate. U.S. Pat. No. 211,532 issued Jun. 25, 1968, to Ashton discloses a serving tray having an overall configuration very similar to that of Minton. U.S. Pat. No. 3,955,672 issued May 11, 1976, to Brundage discloses another plate having a hole in which an open cup is set. In this case, the plate has a channel for balancing the plate on the user's forearm while he grasps the lower end of the cup.

U.S. Pat. No. 4,461,396 issued Jul. 24, 1984, to Harper discloses a plate having a recess for the lower end of a glass in its upper surface. The user's thumb protrudes upwardly through a hole in the plate and presses against the base of the glass to retain it in the recess. This arrangement shares disadvantages with the devices disclosed in the patents cited above. Since the glass is not attached to the plate, momentary relief of the thumb pressure may allow the glass to become dislodged; the drink can easily slosh out of the glass and onto the food; the food can slosh through the hole in the plate; and the food contained on the plate can easily get on the outside of the glass.

U.S. Pat. No. 1,688,992 issued Oct. 23, 1928, to Smith discloses a cup and saucer combination in which the saucer may either support or cover the cup without sliding about. However, the cup and saucer are not attached to each other. U.S. Pat. No. 2,565,912 issued Aug. 28, 1951, to Davis discloses a watercolor paint set in which the palette has a center portion that rests in the mouth of a water container. As the components of these units are not attached to each other, the units have the same disadvantages as Minton's and those of similar character.

The foregoing and other problems appurtenant to the patented arrangements are resolved by the novel plate-and-glass assemblies disclosed in U.S. Pat. No. 5,058,737 issued Oct. 22, 1991 to Patterson et al. These assemblies are made up of: (a) a plate with a generally horizontal upper surface for supporting food, a lower surface, and a peripheral rim; (b) at least one glass for holding a drink, the glass having an open upper end which forms a mouth; and (c) cooperating connector components for so detachably securing the mouth of the glass to the lower surface of the plate that the mouth of the glass is covered by the plate and the glass is positioned in an upright orientation when the plate is positioned to support food. In the patented, Patterson et al. plate-and-glass assemblies, the plate-associated connector component—herein designated a "holder" or "glass holder'-'—is an integral part of the plate with which it is associated.

It was subsequently found (see related application Ser. No. 07/832,436) that an integrally formed glass holder is not required and that one can instead often employ to advantage a holder fabricated as a separate component and subsequently attached to a plate as with an appropriate adhesive, by thermal or ultrasonic welding, or by any other technique appropriate for a particular application of the invention. This provision of a separately fabricated glass holder makes it possible to provide plate-and-glass assemblies which: (1) have the advantages of those disclosed in the '737 patent, but (2) do not require the specially designed plate-with-holder components of the latter. Instead, the novel glass holders disclosed in the parent application allow one to use conventional plates in the plate-and-glass assembly. This has the advantage that the plate can be made of cellulosic and other materials which would perhaps be impractical if the integrated plate-and-glass holder approach disclosed in the '737 patent were employed. Also, the separately fabricated holder gives plate manufacturers an inexpensive entree into the plate-and-glass assembly field.

Separate glass holders of the character disclosed in the just-discussed related application have the disadvantage that it is comparatively expensive to mold these components from plastics, and polymers are often the material of choice. Also, available cups—6, 8, and 12 ounce, for example—differ in diameter at their open, upper ends. This requires that a different glass holder, and therefore different mold, be made available for each different cup size. As a consequence of the foregoing, glass holders as disclosed in the parent application may be too expensive to be used with plates which are non-disposable.

This disadvantage with one-piece glass holders may be overcome by the provision of a triangular array of inexpensive, easily fabricated and applied glass holder components referred to as wedges (see the parent application No. 07/870,392). The spacing of such wedges may be adjustable to allow cups of different sizes to be accommodated.

Additionally, the parent application Ser. No. 07/870,392 recognized the need to accommodate currently-popular insulated plastic containers provided for soft drinks and other beverages. Providing caps having a peripheral recess for these insulated containers allows these containers to be attached to a plate having a glass holder as described in the above-mentioned patent and patent applications filed by the present Applicants. Specifically, this peripheral recess engages the glass holder wedge array of application Ser. No. 07/870,392, the locking component of application Ser. No. 07/832,436, and the integral locking mechanism of the '737 patent.

The parent application also recognized that a straw port may be formed in the side of the cap of the insulated container. The parent application thus provided an apparatus having: (a) a first straw located within the cup and extending through the straw port; and (b) a second straw that mates with the first straw and extends around the plate to allow access to the user. This allowed the user to drink from the container without removing it from the plate.

The wedges provided by the parent application have the disadvantage that they require the separate steps of arranging the wedges in the correct positions on the underside of a plate holder and then adhering the wedges to the plate at these correct positions. They also require a separate injection molding process with attendant molds therefor. Consequently, the costs of manufacturing a plate having a glass holder formed on the underside thereof may be too expensive to be used and then disposed of.

Further, the provision of a straw port in the side of the cap of an insulated container as disclosed in the parent application requires an unwieldy two-straw system: one primarily inside and protruding from the insulated container and one outside the insulated container. This complicates the assembly of the glass and straw to the plate and leaves a hole in the cap through which fluid may leak during transportation.

SUMMARY OF THE INVENTION

It has now been found that principles of the present invention may be conveniently implemented with a plate assembly having a glass holder formed on the underside thereof, where the plate assembly comprises a plate holder adapted to hold a separate disposable plate. Such a plate assembly may be combined with a glass to form a plate-and-glass assembly as discussed in the Applicants' '737 patent and earlier filed applications.

By providing a disposable plate separate from a plate holder, the options available for forming the glass holder on the underside of the plate are increased. For example, tabs formed by punching holes in the bottom of the plate holder can be employed to engage and hold a rim of a drink container. Because the eating surface is formed by the disposable plate and not the plate holder itself, the holes in the plate holder do not adversely affect the ability of the plate assembly to hold food. A plate assembly employing tabs punched in a plate holder as just-described may be cheaply and inexpensively formed.

An additional discovery is that the difficulties of assembly and transportation presented by the straw hole discussed in the parent application may be overcome by providing providing a cap for an insulated container that has a straw recess formed in an upper surface thereof. This straw recess is generally a radially extending groove formed on the upper surface of the cap which communicates with an opening through the cap. Only one straw need be employed with such a straw recess, and this groove is formed in a manner that allows the opening to be closed during transportation to alleviate the problem of spillage during such transportation.

Also, it has been found that there are a number of novel and unobvious features which can be incorporated to advantage in plates designed for plate-and-glass assemblies of the character disclosed herein, whether or not they are intended to be disposable, and that these features can be incorporated to equal advantage in the plates of those assemblies disclosed in the '737 patent and the Applicant's earlier filed patent applications.

Specifically, it has also been discovered that the invention disclosed in the '737 patent and the Applicant's earlier filed application may be adapted to attach a conventional beverage can to a plate assembly. Portions of tabs or wedges attached to the plate holder may be configured to so receive the upper end of the beverage can that the can may be coupled to the provided glass holder. A conventionally present, radial lip or rim at the upper end of the beverage can is trapped between a portion of the holder and the bottom of the plate and thus detachably couples the can to the plate as the can is slid between the tabs or wedges.

Another, also optional but advantageous, innovation is the provision of caps designed to accommodate different styles and sizes of beverage containers to a single glass holder. This is illustrated by the inclusion of nested beverage containers for providing additional insulation of the beverage contained therein during transportation. Specifically, a first, smaller container is contained within a second, larger container. First and second caps are provided for the first and second containers which adapt the mouths thereof to fit a standard glass holder on the underside of the plate assembly. During transportation, the first container is capped and placed within the second container, which is capped and attached to the cup holder. Subsequently, the second cap and container are removed and the first cap is attached to the cup holder while the plate-and-glass assembly is in use. Either container may be used alone, as well.

The Applicant further recognized that the plate holder employed in the present invention may need to be modified to accommodate beverage cans having rims of various diameters. Accordingly, two rails may be provided which deflect to accommodated larger rims.

Alternatively, the rails may each have curved surfaces, where one pair of curved surfaces accommodates larger rims and the other pairs of curved surfaces accommodate smaller rims.

Further objects, features, and advantages of the present invention will be apparent to the reader from the foregoing and the appended claims and as the ensuing detailed description and discussion proceeds in conjunction with the accompanying drawings.

BRIEF DESCRIPTION OF THE DRAWINGS

FIGS. 15 and 16 are perspective and bottom plan views, respectively, of another plate-and-glass assembly adapted to secure beverage cans of differing size rims to the plate; and FIGS. 17 and 18 are perspective and bottom plan views, respectively, of yet another plate-and-glass assembly adapted to secure beverage cans of differing size rims to the plate.

DETAILED DESCRIPTION OF THE INVENTION

Figure 1:
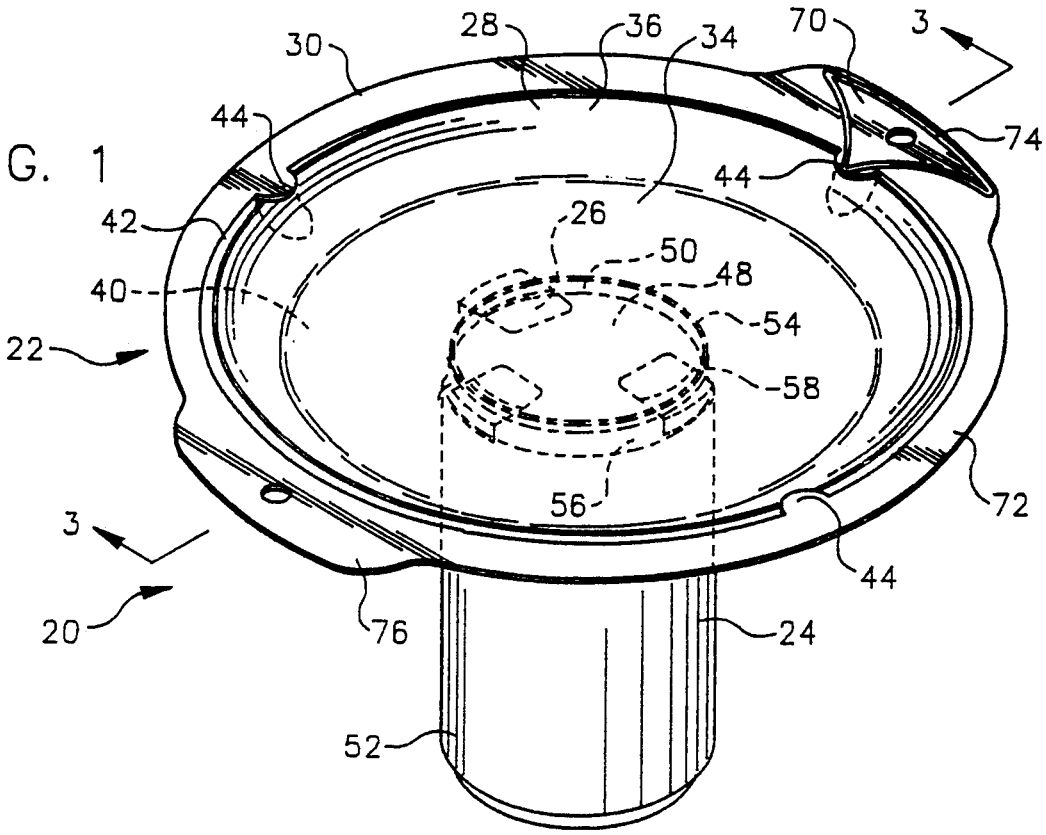
FIG. 1 is a perspective view, looking down on a plate-and-glass assembly employing a separately fabricated glass holder constructed in accord with the principles of the present invention.
Figure 6:
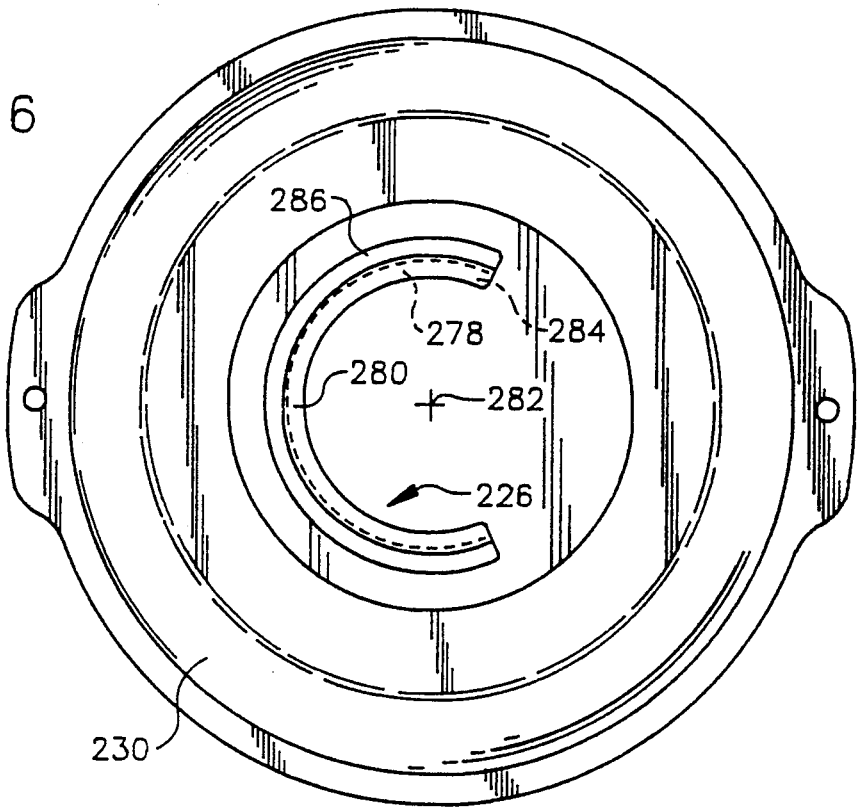
FIG. 6 is a top plan view of another plate-and-glass assembly of the present invention in which the glass holder comprises an arcuate flange.
Figure 2:
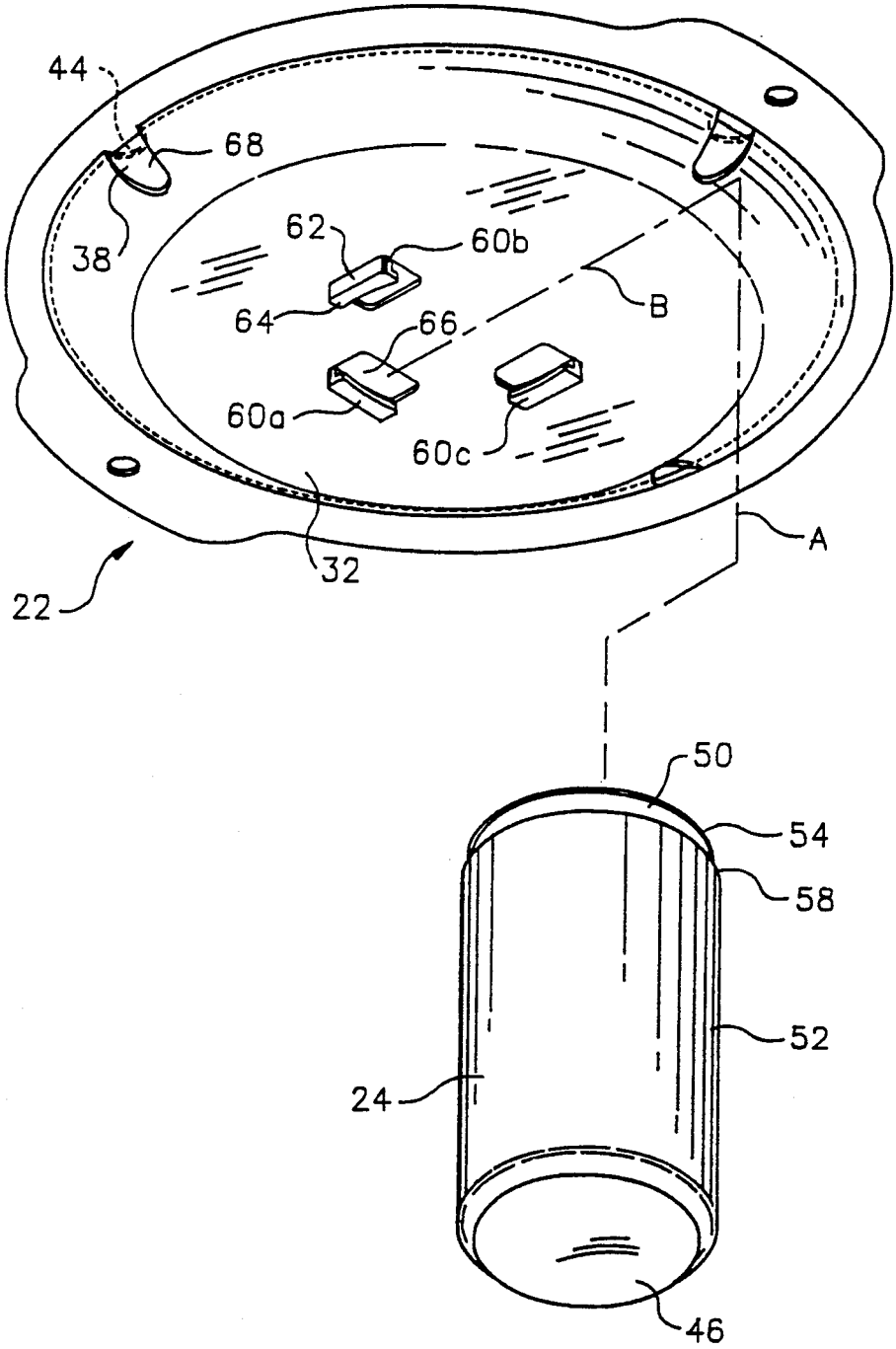
FIG. 2 is an exploded, perspective view, looking up toward the plate-and-glass assembly of FIG. 1.
Figure 3:
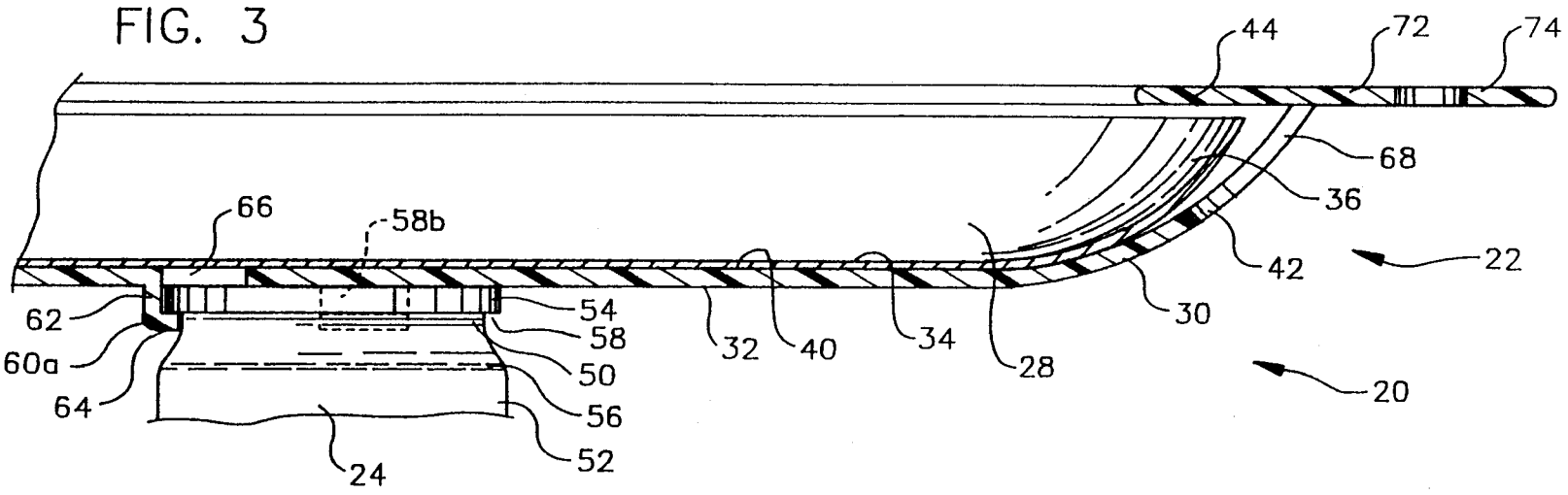
FIG. 3 is a section through FIG. 1, taken substantially along line 3—3 of the latter figure.

Referring now to the drawing FIGS. 1–3, reference character 20 identifies a plate-and-glass assembly constructed in accord with, and employing the principles of the present invention. Referring for the moment to FIGS. 1 and 2, the components of this assembly 20 are: a plate assembly 22; a beverage can 24; an integrally fabricated glass holder 26 which cooperates with the plate to detachably couple the can 24 to the plate 22. The plate assembly 22 itself comprises a disposable plate 28 and a plate holder 30. The glass holder 26 is attached to the bottom 32 (FIG. 2) of the plate holder 22.

The plate 28 is, as mentioned, of the disposable type, and is normally fabricated from synthetic polymers and cellulosic materials such as the heavier grades of paper. The plate holder 30 is generally not disposable, and may be fabricated from such diverse materials as synthetic polymers, porcelains and glasses, metals, and cellulosic materials such as the heavier grades of paper. In this exemplary assembly 20, however, metals, synthetic polymers, and cellulosic materials such as the heavier grades of paper are the materials of choice for reasons that will become clear from the following discussion.

The illustrated, exemplary plate 28 has: (1) a horizontally orientable, upper, food-receiving surface 34 surrounded by an arcuate, upwardly directed side wall 36 which keeps food from sliding off the plate, and (2) a flat lower side or bottom 38 (FIG. 2).

The plate holder 30 depicted in FIG. 1 similarly comprises: (1) a horizontally orientable, upper, surface 40 surrounded by an arcuate, upwardly directed side wall 42 which keeps food from sliding off the plate, and (2) the aforementioned lower side or bottom 32 which is flat and therefore affords some stability when the plate 22 is placed on a supporting surface. Additionally, projecting radially inwardly from the side wall 42 of the plate holder 30 are a number of retaining tabs 44.

The plate holder 30 is designed to receive, support, and retain the plate 28. Specifically, the diameter of the plate side wall 36 is slightly smaller than that of the plate holder side wall 42 so that the plate 28 may placed onto the plate holder upper surface 40. Additionally, the plate side wall 36 extends upwardly from the plate upper surface 34 a distance slightly less than the distance that the plate holder side wall 42 extends above the plate holder upper surface 40.

When the plate 28 is placed on the plate holder upper surface 40, the plate 28 is so snugly received by the plate holder 30 that: (a) the plate holder side wall 42 is adjacent to the plate side wall 36 and thus prevents substantial sideways movement of the plate 28; and (b) the retaining tabs 44 extend over portions of the plate side wall 36 to prevent unintentional upward movement of the plate 28 relative to the plate holder 30. The flexible material from which the plate 28 is preferably constructed allows the plate 28 to flex during insertion under and removal from the retaining tabs 44.

The beverage can 24 assembled to the plate assembly 22 in plate-and-glass assembly 20 is of conventional construction and can similarly be fabricated from a wide variety of materials including those identified above. This illustrated, exemplary glass 24 is an aluminum can and has a generally cylindrical configuration with a closed bottom 46 (FIG. 2) at one end and a closed top 48 (FIG. 1) at the other. As is well-known, the top 48 has a pull tab or other means for creating an opening in the top 48 through which the beverage contained within the can 24 may be drunk.

Surrounding the top 48 of the can 24 is an upwardly extending integral rim 50. This rim 50 is coaxially aligned with, but has a slightly smaller diameter than, a cylindrical side wall 52 of the can 24. This rim 50 also has an integrally formed, radially and outwardly extending lip 54. The rim 50, the lip 54, and a portion 56 (FIG. 1) of the can 24 connecting the rim 50 to the side wall 52 define an annular recess 58 extending around the can 24 below the lip 54. As will be described in more detail below, this recess 58 receives portions of the glass holder 26 so that the glass holder 26 may couple the can 24 to the plate assembly 22.

Referring now more particularly to FIGS. 2 and 3, the integrally fabricated glass holder 26 is formed from three locking tabs 60 that extend downwardly from the bottom surface 32 of the plate holder 30. These locking tabs 60 comprise a downwardly extending portion 62 and a radially inwardly extending portion 64.

The locking tabs 60 are formed from the plate holder 30 material during molding. For example, when the plate holder 30 and glass holder 26 is made of synthetic polymers, these locking tabs 60 may be easily and inexpensively formed during the injection molding process. In a metal or cellulosic plate holder, the downwardly extending and inwardly extending portions 62 and 64 of the locking tabs 60 should be formed by a die-punching process. In this case, the retaining tabs 44 may be similarly die-punched from the plate holder 30. It should be clear that a large number of combinations of materials and manufacturing methods may be employed to make these plate-holders; however, the use of injection molded polymers is generally preferred.

This injection-molding process creates holes 66 in the plate holder 30. The retaining tabs 44 have similar corresponding holes 68 in the side wall 42 of the plate holder 30. However, because the plate 28 and not the plate holder 30 receives food, the plate 28 covers these holes 64 and 66 as shown in FIG. 3 and thus do not adversely affect the ability of the plate assembly 22 to contain the food.

Additionally, these holes 66 have the advantage that a plurality of plate holders such as the plate holder 30 may be stacked one on top of another. When the plate holders are so stacked, the holes 66 receive the tabs 60 of the plate holders above, allowing the upper surface of one plate holder to abut the lower surface of the plate holder above. This greatly reduces the amount of space necessary for storing and transporting large quantities of such plate holders.

Referring now more specifically to FIG. 3, it can be seen that the inwardly extending portions 64 of the locking tabs 60 extend into the aforementioned recess 58 below the lip 54 of the can 24. These portions 64 thus underlie and abut the lip 54. The lip 54 itself lies under and abuts the bottom surface 32 of the plate holder 30. This arrangement prevents relative upward movement between the plate holder 30 and the can 24.

Additionally, the three locking tabs **60*a*, 60*b*, and 60*c* are arranged to receive the can 24 in a manner that allows relative lateral displacement between the can 24 and the plate holder 30 only in one direction. Specifically, these tabs 60*a*, 60*b*, and 60*c* are arranged in a triangular configuration with the distance between the tabs 60*b* and 60*c* being greater than the distance between the tabs 60*a* and 60*b* and the distance between the tabs 60*a* and 60*c*. The distance between the tabs 60*b* and 60*c* is approximately the same as the diameter of the lip 54 of the can 24**.

When the tabs 60 are arranged as just-described, the can 24 may be brought into contact with the bottom 32 of the plate holder 30 (line segment A in FIG. 2) and laterally displaced between the tabs **60*b* and 60*c* towards the tab 60*a* (line segment B in FIG. 2). When the can 24 is aligned with the center of the plate holder, the lip 54 of the can 24 comes into contact with the downwardly extending portion 62 of the tab 60*a*, as shown in FIG. 3**.

The tabs **60*a*, 60*b*, and 60*c* thus couple the can 24 to the plate holder 30 in a manner that allows relative movement between the can 24 and the plate holder 30 only along the line segment B shown in FIG. 2**; movement in all other directions is prevented.

The tabs **60*b* and 60*c* may also be arranged so that they deflect slightly when the widest part of the can 24 passes therebetween and then return to their original position when the can lip 54 engages the tab 60*a*. Tabs so arranged engage the can lip 54 and establish a positive locking action that inhibits unintended movement of the can 24 relative to the plate holder 30. Friction between the can lip 54 and the bottom surface 32 of the plate holder 30** further inhibits movement of the can along the line segment B.

To indicate the direction in which the can 24 must be displaced to couple it to the plate holder 30, indicia 70 may be formed on a rim 72 extending radially outwardly from the top of the plate holder side wall 42. Handles 74 and 76 may also be formed on the rim 72 on opposing sides of the plate holder 30 to facilitate handling of the plate-and-glass assembly 20. The rim 72 increases the structural strength of the plate holder 30.

The plate-and-glass assembly 20 described above: (a) may be cheaply and conveniently manufactured; (b) provides a stable apparatus for eating and drinking when no surface is available on which a beverage can may be placed; (c) allows disposable plates to be used while at the same time allows the beverage can to be coupled with a plate holder which supports the disposable plates; and (d) allows plate holders to be stacked together in a space efficient manner.

Figure 5:
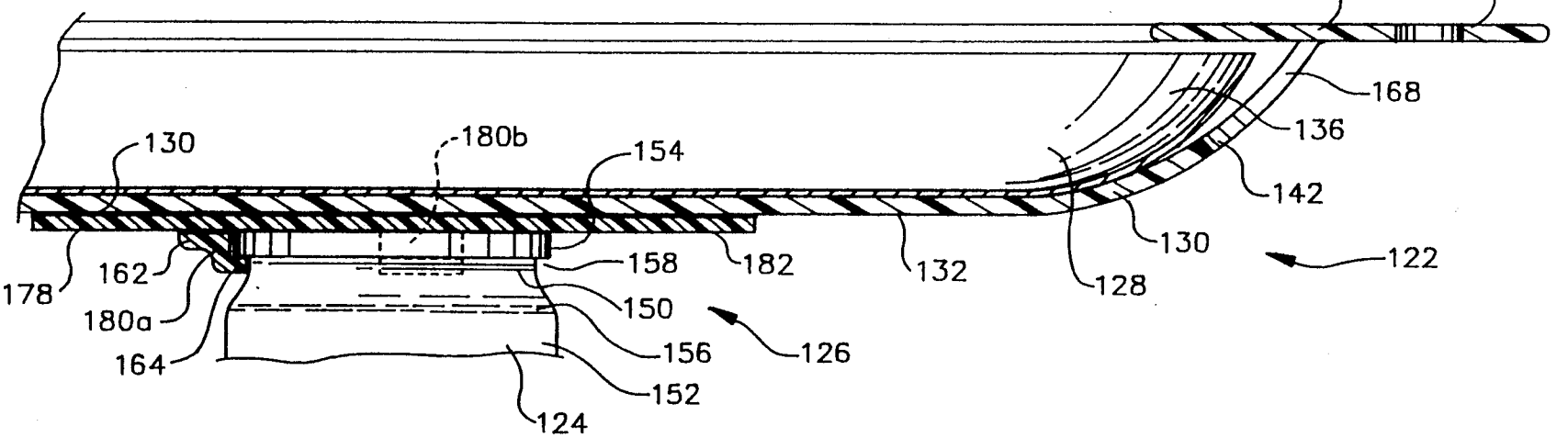
FIG. 5 is a section view of the plate-and-glass assembly depicted in FIG. 4 showing details of fabrication and assembly thereof.
Figure 4:
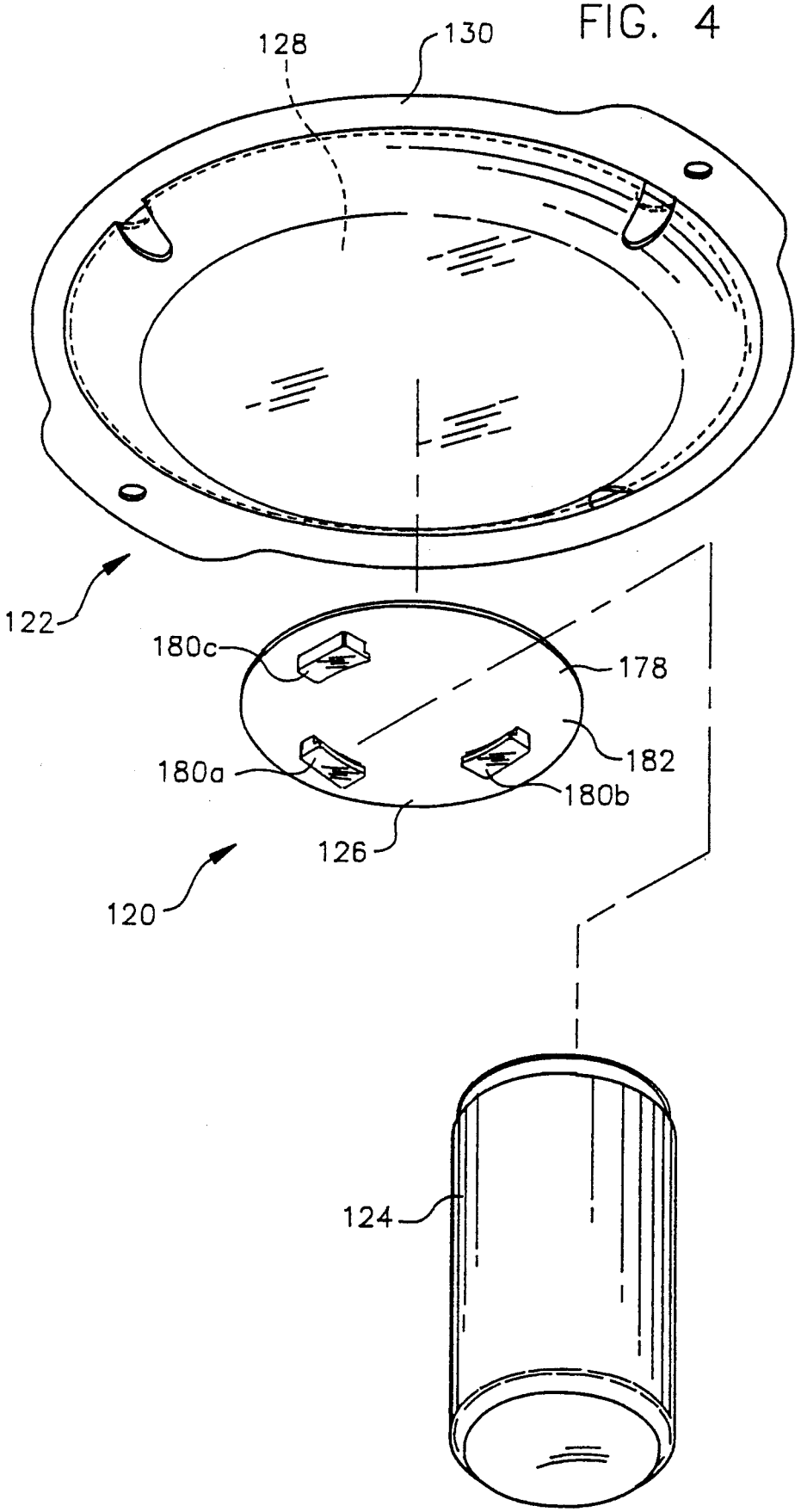
FIG. 4 is a bottom view of a separately fabricated glass holder employed in another plate-and-glass assembly of the present invention.

Referring now to FIGS. 4 and 5, depicted therein at 120 is another exemplary plate-and-glass assembly constructed in accordance with the present invention. The plate-and-glass assembly 120 is constructed and used in a manner similar to that of the plate-and-glass assembly 20 described above, so the plate-and-glass assembly 120 will be described below only to the extent that it differs from the assembly 20. For purposes of clarity and brevity, reference characters identifying elements of the plate-and-glass assembly 120 will be the same as those used to identify corresponding elements of the plate-and-glass assembly 20 plus one hundred.

The primary difference between the plate-and-glass holders of the exemplary assemblies 20 and 120 is that the glass holder 126 is not integrally formed with the plate holder 130. Instead, the glass holder 126 comprises a disc-shaped mounting plate 178 and an array of three mounting wedges 180. The mounting wedges 180 are attached to a bottom surface 182 of the mounting plate 178 in an triangular configuration like that of the tabs 60 of the assembly 20. Like the configuration of tabs 60, the configuration of wedges 180 allows relative lateral displacement between the can 124 and the plate holder 130 only in one direction.

The mounting plate 178 and wedges 180 are formed of any material mentioned above as being available for forming the plate holder 130. The wedges 180 are bonded to the mounting plate bottom surface 182 by any appropriate means for bonding the materials employed to form the wedges 180 and the mounting plate 178. Similarly, the mounting plate 178 is bonded to the plate holder bottom surface 132 by means appropriate for bonding materials employed to form the mounting plate 178 and plate holder 130.

As shown in FIG. 5, the wedges 180 each comprise an upper portion 162 and a lower, radially inwardly extending portion 164. The mounting portion 162 is attached to the mounting plate 178, while the inwardly extending portion 164 engages the lip 154 of the beverage can 124.

In this exemplary plate-and-glass assembly 20, when the can 124 is coupled to the plate holder 130, the lip 154 thereof is trapped between the inwardly extending portions 164 of the wedges 180 and the bottom surface 182 of the mounting plate 178; the can 124 thus does not come into direct contact with the plate holder 130.

The mounting plate 178 and wedges 180 may be inexpensively formed by injection or other appropriate molding process. They may be attached together as described above and then: (a) attached to a plate holder at the factory; or (b) included in an upgrade kit to retrofit an existing plate holder 130 with the properties of a plate-and-glass assembly as described herein.

Shown in FIG. 5 is yet another exemplary plate holder 230 of plate-and-glass assembly constructed in accordance with, and embodying, the present invention. This plate holder 230 is constructed and used in a manner generally similar to that of the plate holder 30 of the assembly 20; accordingly, the plate holder 230 will be described below only to the extent that it materially differs from the plate holder 30. Reference characters identifying elements of the plate holder 230 will be the same as those used to identify corresponding elements of the plate holder 30 plus two hundred.

The plate holder 230 may be fabricated from the same types of materials as plate holder 30, with components of that character ejection or otherwise molded from a thermoplastic polymer and those fabricated from a cellulosic pulp by the forming technique employed for egg cartons and comparable artifacts typically being preferred because they are inexpensively and easily manufactured.

The glass holder 226 of the plate holder 230 is formed by a semi-circular slot 278 incorporated in the depicted plate holder 230. A beverage container is rectilinearly displaced into this slot 278 during the course of assembling the plate holder 230 and the container. This slot 278 comprises a closed end 280 so located that the center of the slot 278 is coincident with: (a) the center 282 of the plate holder 230, and (b) the axis of symmetry of the associated container when the plate and container are assembled together. By thus centering the slot 278, maximum stability is imparted to plate-and-glass assembly constructed therewith.

The U-shaped slot 278 of the glass holder 226 is bounded by a downwardly and then radially inwardly extending flange 284. This flange 284 engages the lip of the beverage container associated with the plate holder 230 in a manner similar to that in which the locking tabs 60 and wedges 180 engage the container lips 154 and 254.

The flange 284 is formed by a die-punch process similar to that described above in relation to the locking tabs 60. This die punch process results in a semi-circular hole 286 being formed in the plate holder 230.

Figure 7:
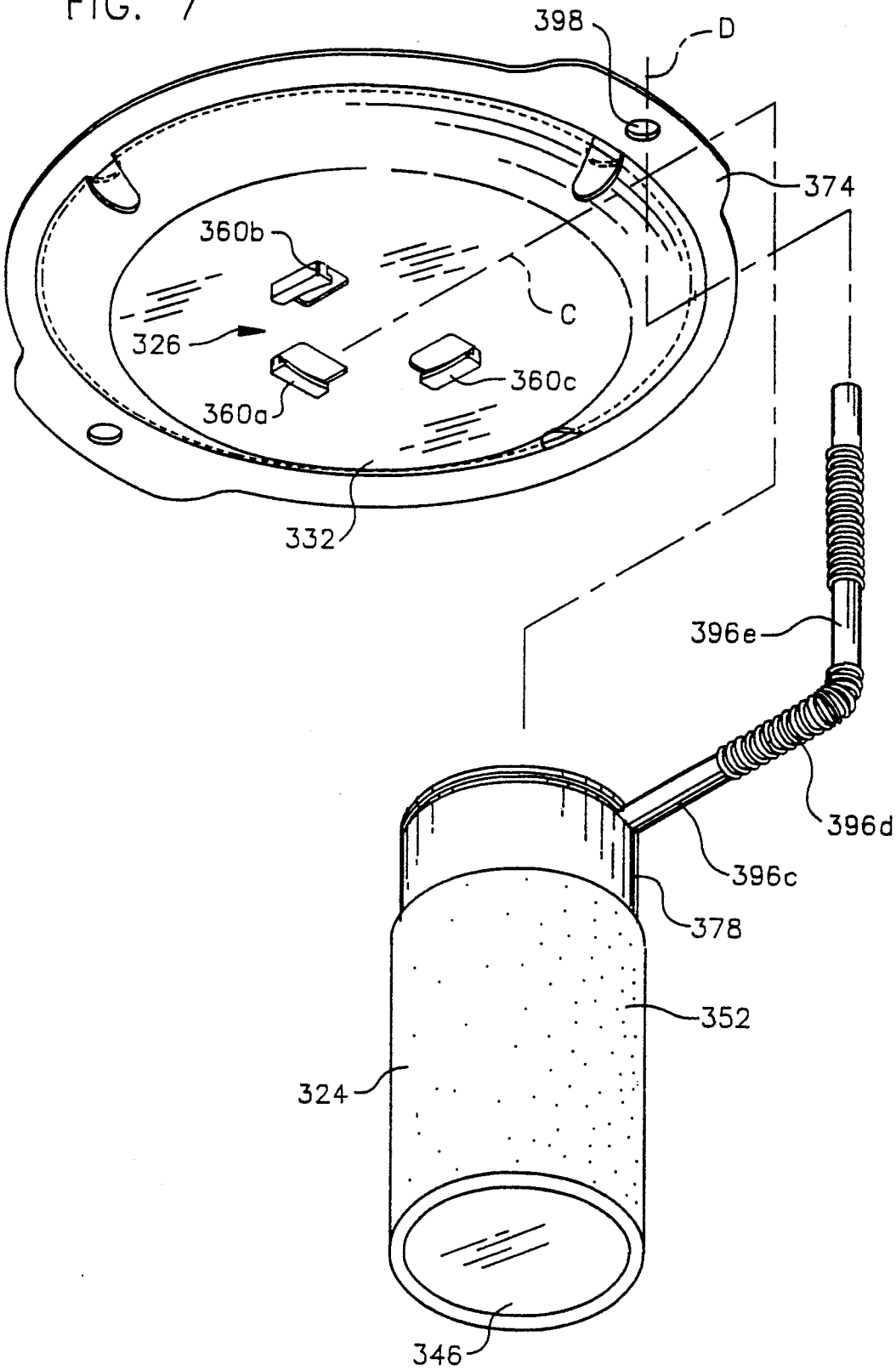
FIG. 7 is an exploded, perspective view, looking up toward another plate-and-glass assembly implementing the principles of the invention.
Figure 8:
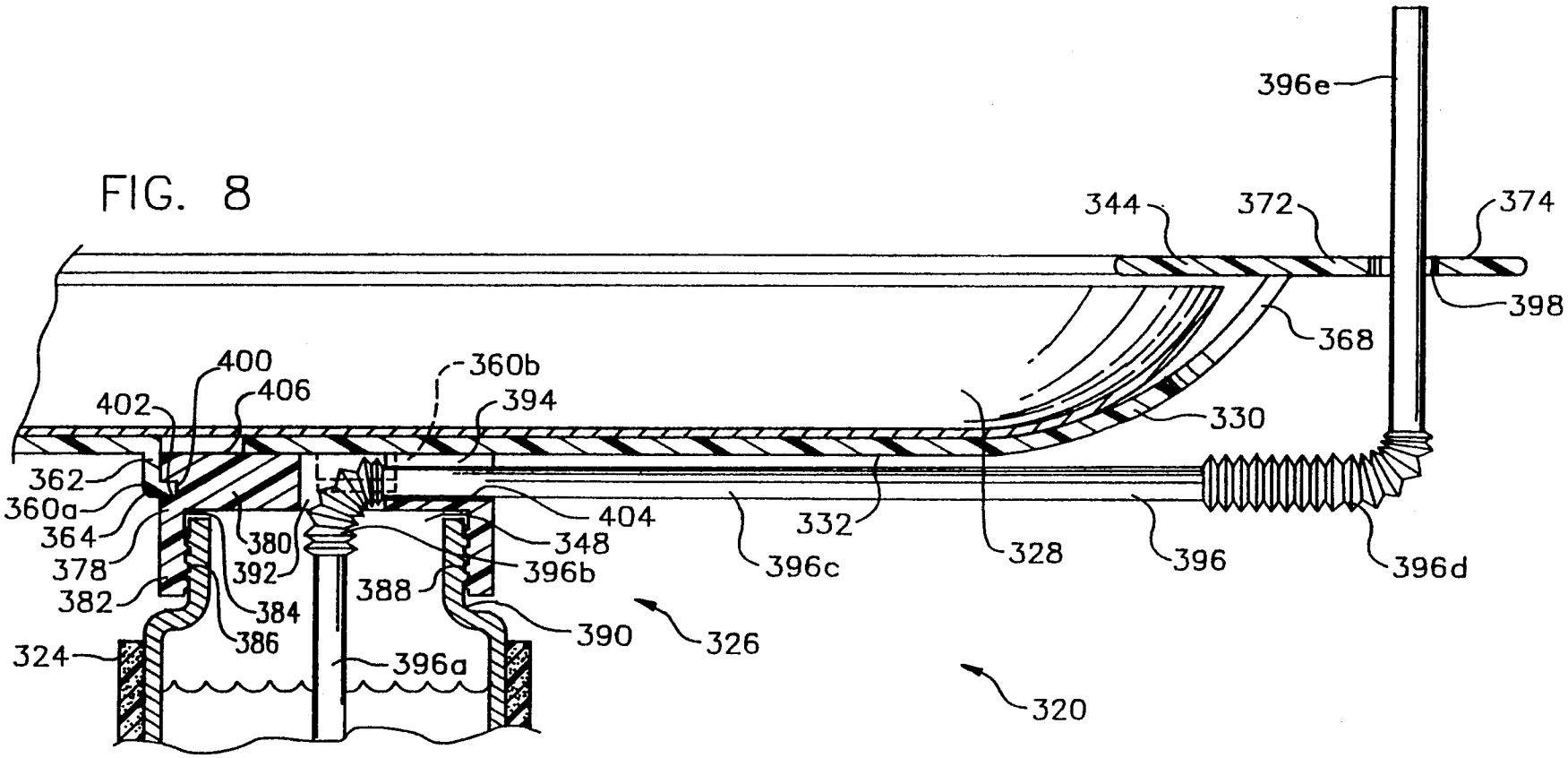
FIG. 8 is a section view of the plate-and-glass assembly depicted in FIG. 7 showing details of fabrication and assembly of a plate-and-glass assembly employing a separate cap and radially extending slot formed thereon for insertion of a straw into the beverage container.

Another exemplary plate-and-glass assembly 320 illustrative of the present invention is shown in FIGS. 7 and 8 and will now be described. This plate-and-glass assembly 320 operates in the same basic manner as the in a manner similar to that of the plate-and-glass assembly 20 described above, so the plate-and-glass assembly 320 will be described below only to the extent that it differs from the assembly 20. As before, reference characters identifying elements of the plate-and-glass assembly 320 will be the same as those used to identify generally corresponding elements of the plate-and-glass assembly 20, but in the following discussion the reference characters will be increased by three hundred.

The primary difference between the plate-and-glass assemblies 20 and 320 is the construction of the beverage container 324. The beverage container 324 is an insulated container having a closed bottom end 346 and an open top end 348. The open top end 348 may be closed by a cap 378.

The cap 378 generally comprises a top portion 380 and a cylindrical wall 382 downwardly extending from the top portion 380. An inner surface 384 of the wall 382 is threaded at 386. This threaded surface 384 is designed to mate with a threaded portion 388 on an outer surface 390 of the beverage container 324. The cap 378 may thus be attached to the container 324 in a manner that substantially prevents leakage of the beverage contained therein between these surfaces 384 and 390.

Formed in the top portion 380 of the cap 378 is an orifice 392 and a slot 394. The orifice 392 extends upwardly through the center of the top portion 380. The slot 394 extends radially outwardly from the orifice 392. The orifice 392 allows a portion of a straw 396 to be inserted into the interior of the beverage container 324.

The straw 396 has a first straight portion **396*a*, a first flexible portion 396*b*, a second straight portion 396*c*, a second flexible portion 396*d*, and a third straight portion 396*e*. The first straight portion 396*a* extends through the orifice 392 into the interior of the container 324. The first flexible portion 396*b* allows the straw 396 to bend so that the second straight portion can lie within the slot 394 parallel to the bottom surface 332 of the plate holder 330. The second flexible portion 396*d* is positioned to allow the straw 396 to bend so that the third straight portion 396*e* can extend upwardly through a hole 398 in the handle 374 of the plate holder 330**.

Also formed on the top portion 380 of the cap 378 is an annular recess 358. A bottom surface 400 of this recess 358 is coplanar with the bottom surface 402 of the slot 394. Additionally, a distance between the top surface 404 of the top portion 380 and the bottom surfaces 400 and 402 is slightly greater than the diameter of the straw 396.

The plate-and-glass assembly 320 is assembled for use in the following manner. Initially, the cap 378 is screwed onto the container 324. The first straight portion **396*a* of the straw is next inserted into the container 324 through the orifice 392 in the cap 378. The straw 396 is then bent at the first flexible portion 396*b* so that part of the second straight portion 396*c* lays in the slot 394. The container 324 and cap 378 are then brought into contact with the bottom surface 332 of the plate holder 330 and displaced laterally relative to the plate holder 330 along line segment C in FIG. 7 towards the locking tab 360*a* until the cap 378 contacts the tab 360*a*. The locking tabs 360 engage the recess 358 in the cap 378 in a manner that holds the cap 378 against the plate holder bottom surface 332. The container 324 is thus securely coupled to the plate holder 330. At this point, part of the second straight portion 396*c* of the straw 396** resides in a passageway formed by the walls of the slot 394 and the bottom surface 332 of the plate holder 330. The third straight portion 396e of the straw 396 may then be threaded through the straw hole 398 along the line segment D depicted in FIG. 7.

At this point, the plate-and-glass assembly 320 may be used to support food on the upper surface of the plate 28 and supply beverage through the straw 396.

To assemble the plate-and-glass assembly 320 for transportation and storage, the process just-described is followed except that the straw 396 is not inserted through the orifice 392 in the cap 378 or the straw hole 398 in the plate holder handle 374. Instead, once the container 324 is coupled to the plate holder 330, the container 324 is rotated until the slot 394 is covered by one of the locking tabs 360. The beverage within the container 324 will not slosh out of the container 324 through the orifice 392 and slot 394 when it is subjected to the jolts that may be expected during normal transportation. Closed-cell foam or other sealing material may also be provided on the inner surfaces of the locking tabs 360 to seal the slot 394.

Figure 9:
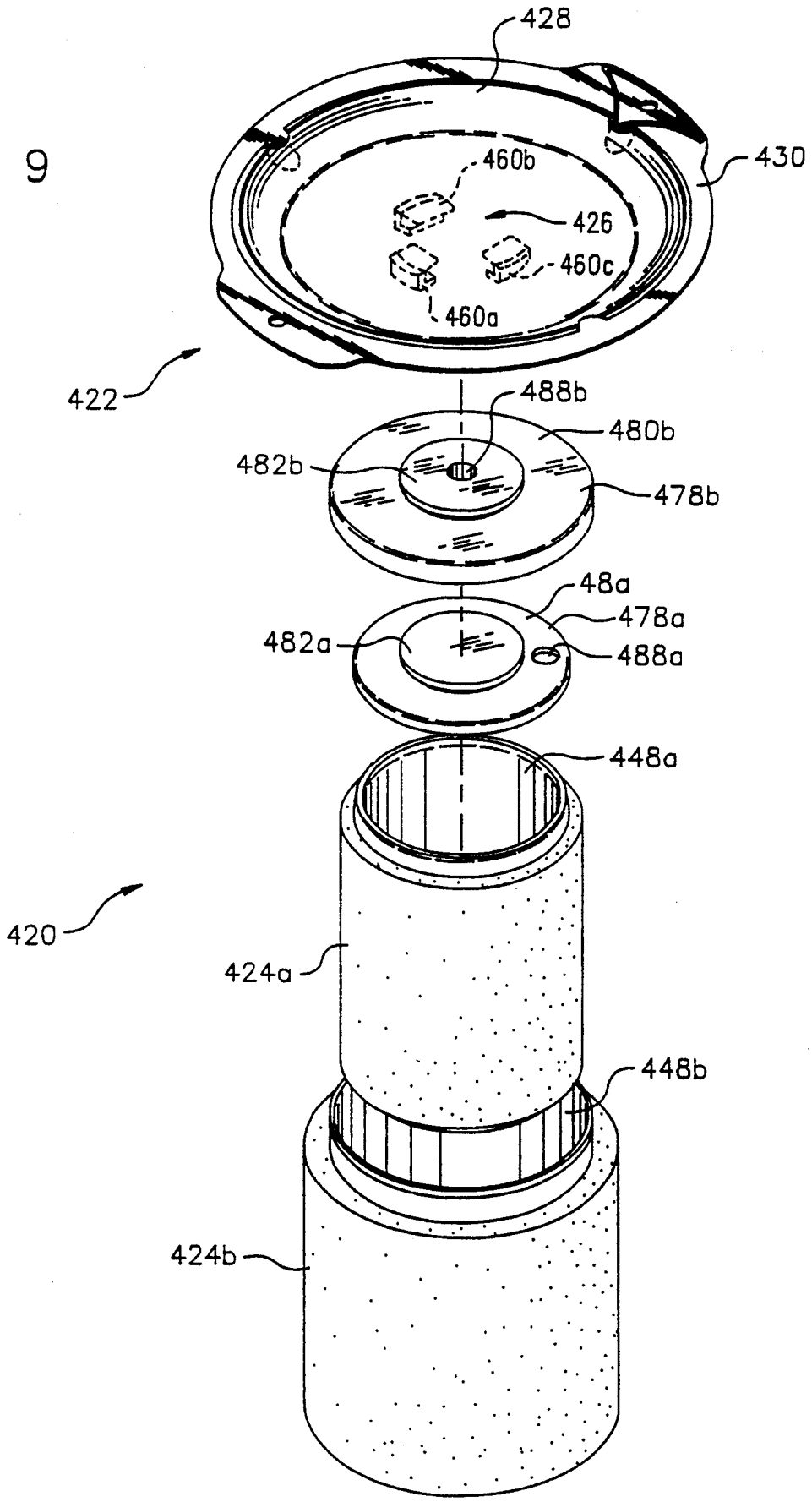
FIG. 9 is an exploded perspective view, looking down on a plate-and-glass assembly employing yet another separately fabricated glass holder.
Figure 10:
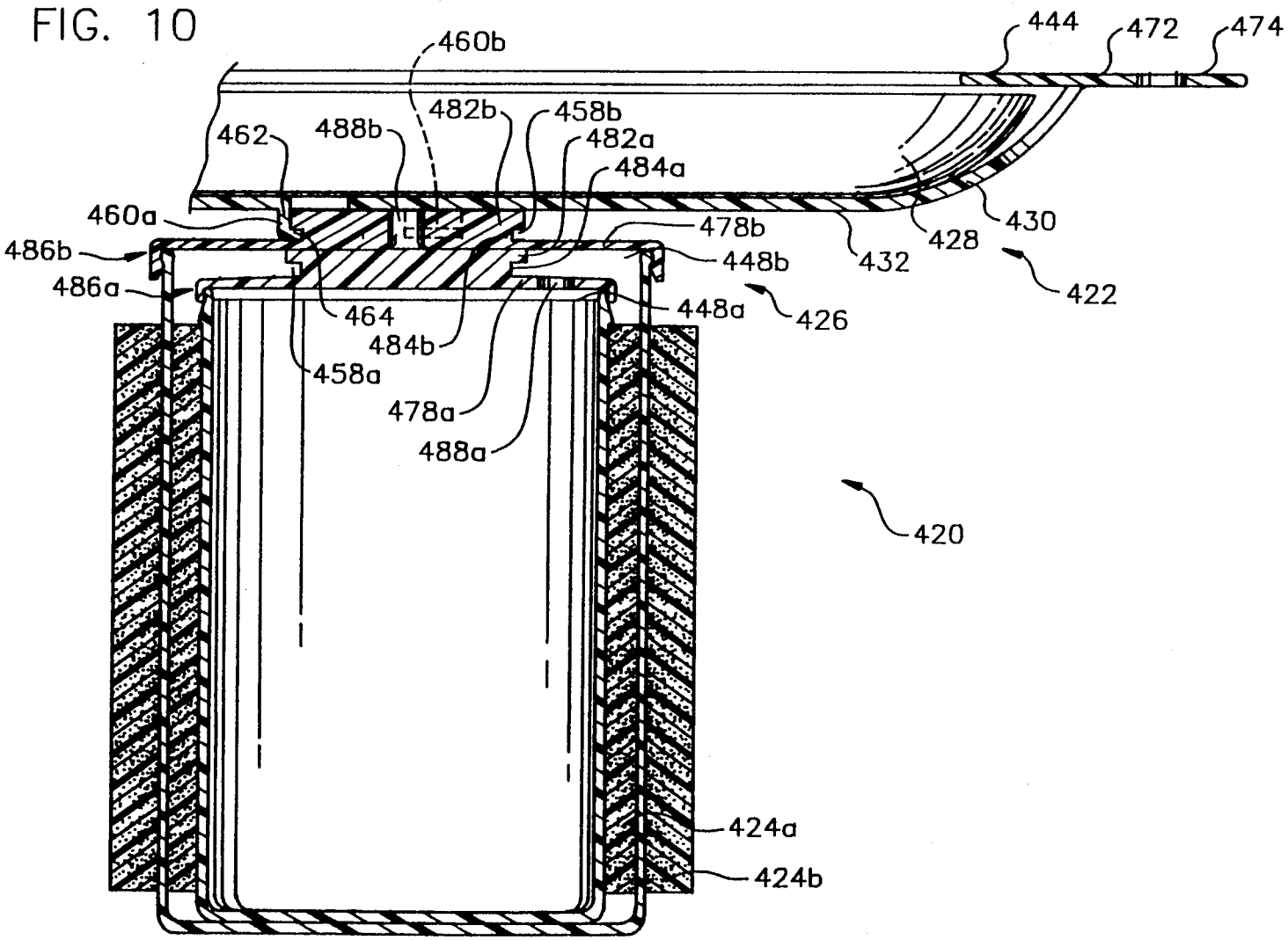
FIG. 10 is a section view of the assembly depicted in FIG. 9 showing details of fabrication and assembly of a plate-and-glass assembly employing nested beverage containers.

Another exemplary plate-and-glass assembly is depicted at 420 in FIGS. 9 and 10. This plate-and-glass assembly 420 operates in the same basic manner as the in a manner similar to that of the plate-and-glass assembly 20 described above; the plate-and-glass assembly 420 will thus be described below only to the extent that it differs from the assembly 20. Reference characters identifying elements of the plate-and-glass assembly 420 will be the same as those used to identify generally corresponding elements of the plate-and-glass assembly 20; however, in the following discussion the reference characters will be increased by four hundred.

In the plate-and-glass assembly 420, a first beverage container 424a and a second beverage container 424b are supported by the glass holder 426 below the plate assembly 430. In general, the first beverage container 424a is nested within the second beverage container 424b; the glass holder 426 then couples the second beverage container to the bottom surface 432 of the plate holder 430.

More particularly, the first and second beverage containers 424a and 424b are provided with corresponding first and second caps 478a and 478b. These caps 478a and 478b are adapted to lock onto and substantially cover the open upper ends 448a and 448b of the containers 424a and 424b. Also, formed adjacent to the upper surfaces 480a and 480b of the caps 478a and 478b are coupling discs 482a and 482b. As shown in FIG. 10, these coupling discs 482a and 482b are attached to these upper surfaces 480a and 480b by disc-shaped connecting portions 484a and 484b which are coaxially aligned with, and have a slightly smaller diameter than, the coupling discs 482a and 482b. This arrangement creates annular recesses 458a and 458b on the caps 478a and 478b into which the radially inwardly extending portions 464 of the locking tabs 460 extend to couple the caps 478a and 478b to the plate holder 430.

One example of the use of the plate-and-glass assembly 420 is as follows. Initially, a beverage is poured into the first beverage container 424a. The first cap 478a is then locked into place over the open end 448a of the first container 424a. The entire first container 424a and the cap 478a are then placed within the second container 424b. The second cap 478b is then locked into place over the open end 448b of the second container 424b. The second container 424b is then brought into contact with the lower surface 432 of the plate holder 430 and displaced laterally between the locking tabs 460a and 460b towards the locking tab 460a. The radially inwardly extending portions 464 of the locking tabs 460 enter the recess 458b and engage the coupling disc 482b on the second cap 478b. The second cap 478b is securely held by the locking tabs 460 and the second container 424b is thus coupled to the plate holder 430. The plate assembly 422 and the beverage containers 424a and 424b are thus assembled into the plate-and-glass assembly 420 for storage and/or transportation.

After the assembly 420 is transported to its destination, the beverage containers 424a and 424b are decoupled from the plate holder 430 by sliding the second beverage container 424b away from the locking tab 460a and out between the locking tabs 460b and 460c so that these tabs 460 no longer engage the coupling disc 482b. The second cap 478b is then detached from and the first container 424a is first container 424a may then be brought into contact with the bottom surface 432 of the plate holder 430 and displaced laterally towards the locking tab 460a between the locking tabs 460b and 460c; the radially inwardly extending projections 464 thus enter the annular recess 458a, allowing the tabs 460 to engage the coupling disc 482a. The first container 424a is thus securely coupled to the plate holder 430, and the plate-and-glass assembly formed thereby may be used in the normal fashion.

It should be specifically noted that caps 478a and 478b are designed in a manner that allows containers of differing diameters to be coupled to plate assemblies having a glass holder constructed to accommodate only one diameter of beverage container. Even if nested containers such as the containers 424a and 424b shown in FIGS. 9 and 10 are not employed, caps such as caps 478a and 478b may be employed as adapters to connect a variety of different container styles to a single glass holder.

For example, referring again to FIG. 10, it can be seen that a locking mechanism 486a employed to lock the first cap 478a to the first container 424a is different from a locking mechanism 486b employed to lock the second cap 478b to the second container 424b. Specifically, the locking mechanism 486a may be characterized as a friction fitting which primarily employs friction to lock the first cap 478a to the first container 424a. On the other hand, the locking mechanism 486b may be characterized as a detent-type fitting that uses a projection 488 on the cap 478b which deflects radially outwardly during locking and returns to its original position when the cap 478b is locked into place. By appropriate design of the caps 478a and 478b, both of these locking mechanisms 486a and 486b may be accommodated in glass holder 426.

Also, any number of methods for inserting a straw into the beverage containers may be employed in this plate-and-glass assembly 420. For example, a first straw hole 488a is spaced radially outwardly from the center of the cap 478a. A second straw hole 488b is additionally placed in the center of the cap 478b. The placement of such straw holes may be chosen as appropriate for a given set of circumstances.

Figure 11:
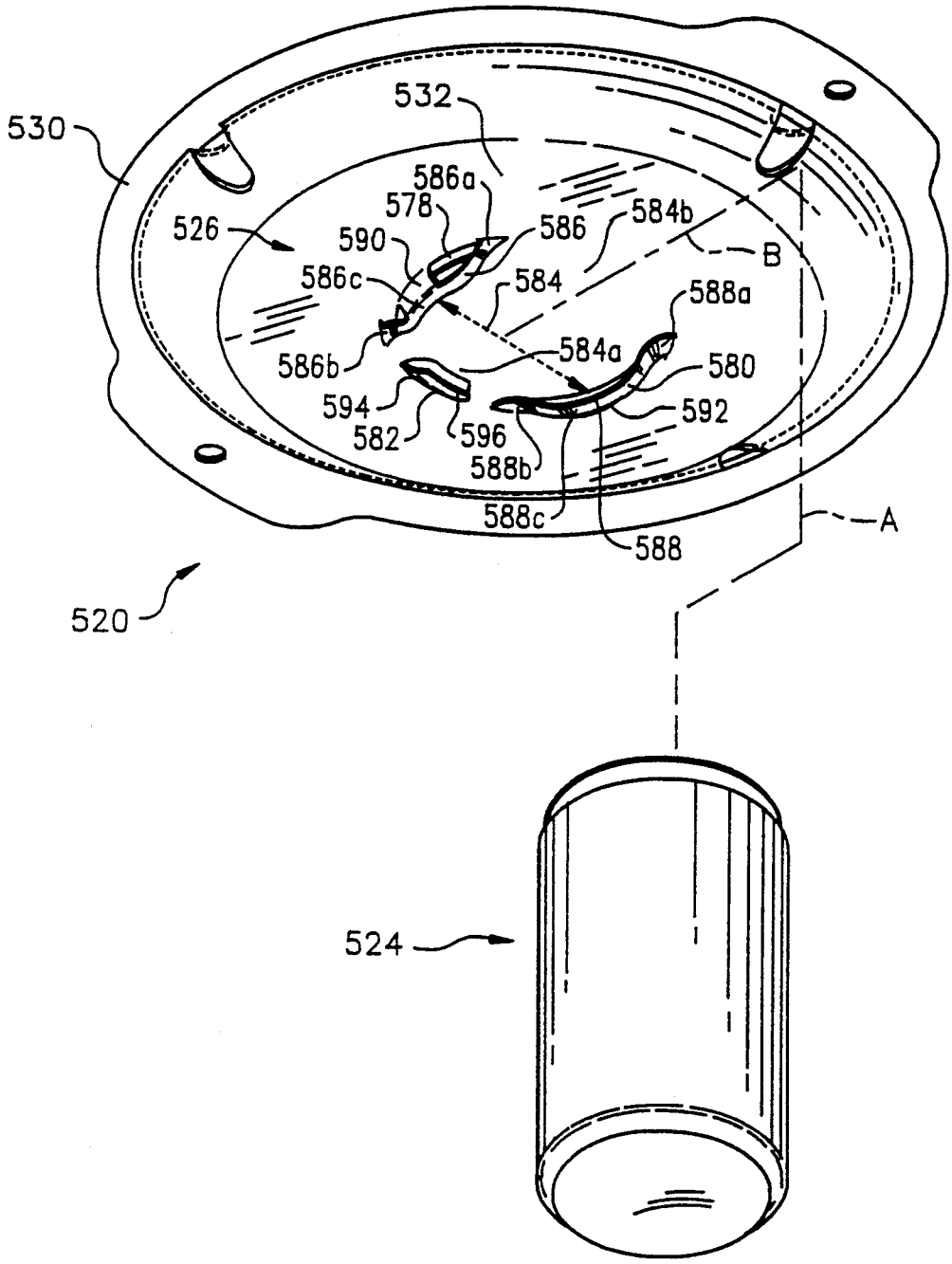
FIG. 11 is an exploded perspective view, looking up at a plate-and-glass assembly adapted to secure beverage cans of differing size rims to the plate.
Figure 12:
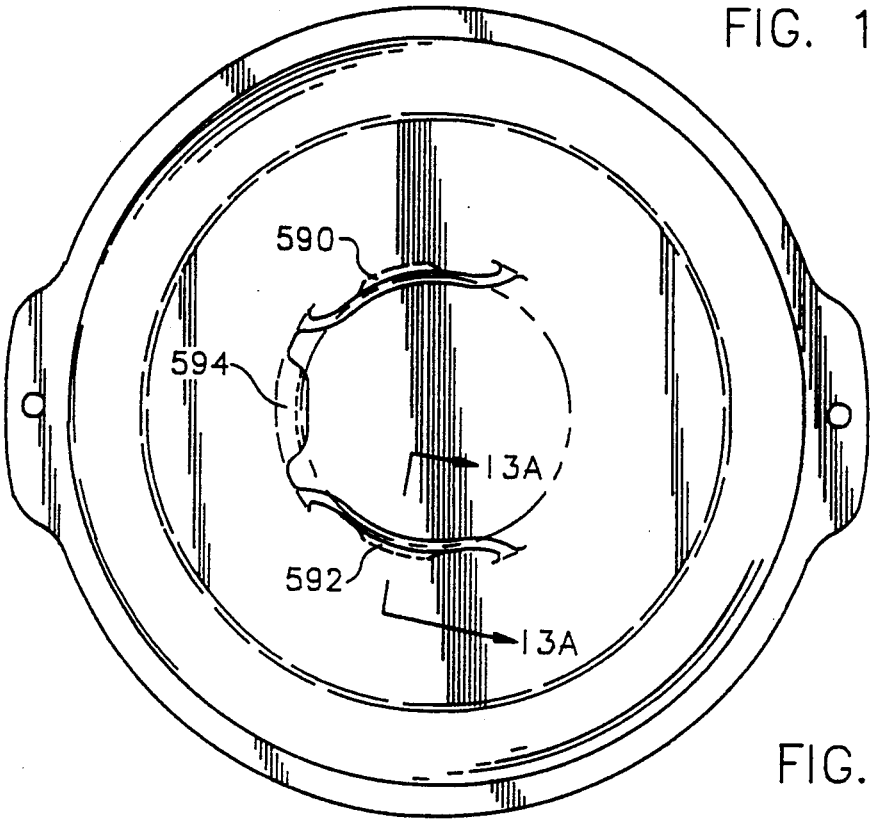
FIG. 12 is a bottom plan view depicting the plate-and-glass assembly shown in FIG. 11.

Yet another plate-and-glass assembly exemplary of the present invention is indicated at 520 in FIGS. 11-13. This assembly 520 is constructed and operates in a manner basically the same as the plate-and-glass assembly 20 described above; the plate-and-glass assembly 520 will thus be described below only to the extent that it differs from the assembly 20. Reference characters identifying elements of the plate-and-glass assembly 520 will be the same as those used to identify generally corresponding elements of the plate-and-glass assembly 20; however, in the following discussion the reference characters will be increased by five hundred.

The plate-and-glass assembly 520 comprises a glass holder 526 that is designed to attach containers 524 of various sizes to the the bottom surface 532 of the plate holder 530. Beverage containers may be sold in a plurality of diameters. For example, aluminum cans are currently available in 202, 204, and 206 sizes. While it is not specifically relevant to the present invention, these sizes refer to can diameters of 2 2/16", 2 4/16", and 2 6/16 inches, respectively. Because of the relatively slight differences in can size, the consumer is generally not aware of the can size when purchasing a canned beverage; however, for a plate-and-glass assembly to operate effectively, these various can sizes must be accommodated by the plate-and-glass assembly with little effort, skill, or attention on the part of the consumer.

Referring now more particularly to the glass holder 526, this holder 526 comprises first and second elongate tabs 578 and 580 and a short tab 582. A container receiving area 584 is defined between the elongate tabs 578 and 580. The short tab 582 is so arranged relative to the elongate tabs 578 and 580 that the tab 582 closes an end **584*a* of the area 584, a second end 584*b* of the area 584 being open to allow the beverage container 524 to enter the area 584**.

The elongate tabs 578 and 580 comprise lower rail portions 586 and 588 and bridge portions 590 and 592. Still referring to FIG. 11, ends **586*a,b* and 588*a,b* of the rail portions 586 and 588 are attached to, or integrally formed with, the bottom surface 532. The bridge portions 590 and 592 are arranged between centers 586*c* and 588*c* of the rail portions 586 and 588 and the bottom surface 532. The short tab 582 comprises a first portion 594 that extends downwardly from the bottom surface 532 and a second portion 596 that inwardly extends from the lower end of the first portion 594**.

Figure 13A:
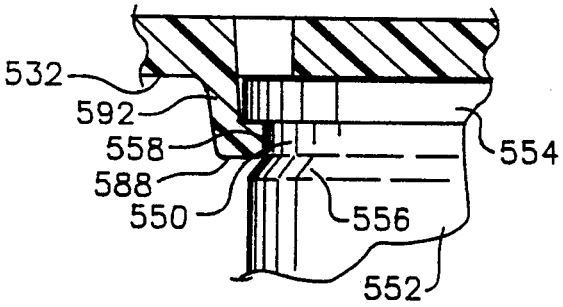
FIGS. 13A is a perspective cut-away view taken along lines 13A in FIG. 12.
Figure 13B:
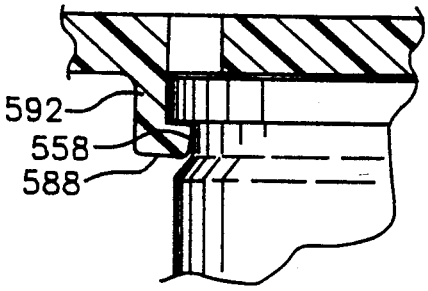
FIGS. 13B is a perspective cut-away view taken along lines 13B in FIG. 14.

As with the other embodiments, the beverage container 524 is raised along line A and then laterally displaced along line B into the container receiving area 584 through the opening **584*b* (FIG. 11). As shown in FIGS. 13A and 13B, the rails 588 and 590 extend into recesses 558 defined by the container rim 550, lip 554, and portion connecting the rim 50 to the container exterior wall 552. The rails 588 and 590 engage the lip 554 to prevent downward movement of the container 524 relative to the plate holder 530**.

Figure 14:
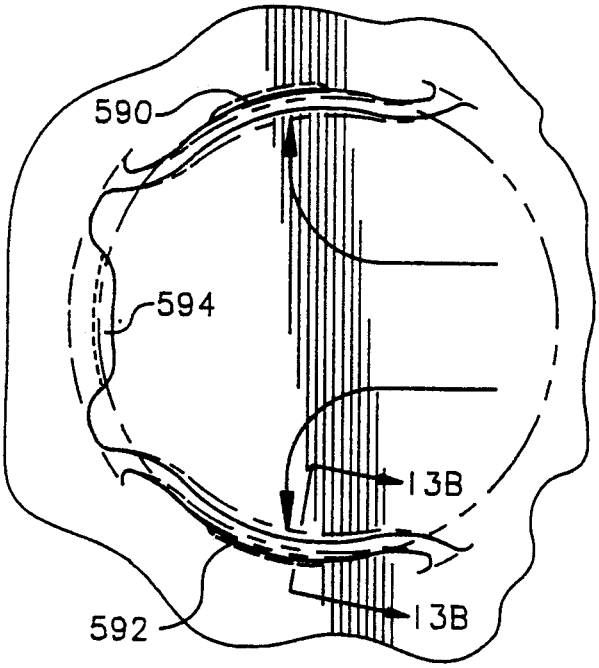
FIG. 14 is a bottom plan view depicting the plate-and-glass assembly shown in FIG. 11.

The glass holder 536 is able to accommodate cans of various diameters because the rails 588 and 590 deflect when cans with larger diameters are placed in the receiving area 584. Specifically, FIGS. 12 and 13A depict a situation in which a beverage container **524*a* of relatively smaller diameter is attached to the plate holder 530, while FIGS. 14 and 13B show a relatively larger diameter container 524*b* attached to the holder 530. A comparison of FIGS. 13A and 13B shows that the rails 588 and 590 are deflected outwardly when the larger container 524*b* is held thereby. It should be noted that both the rail portions 588 and 590 and the bridge portions 592 and 594** must be made of resilient, elastic material that allows the above-described deflection.

Figure 15:
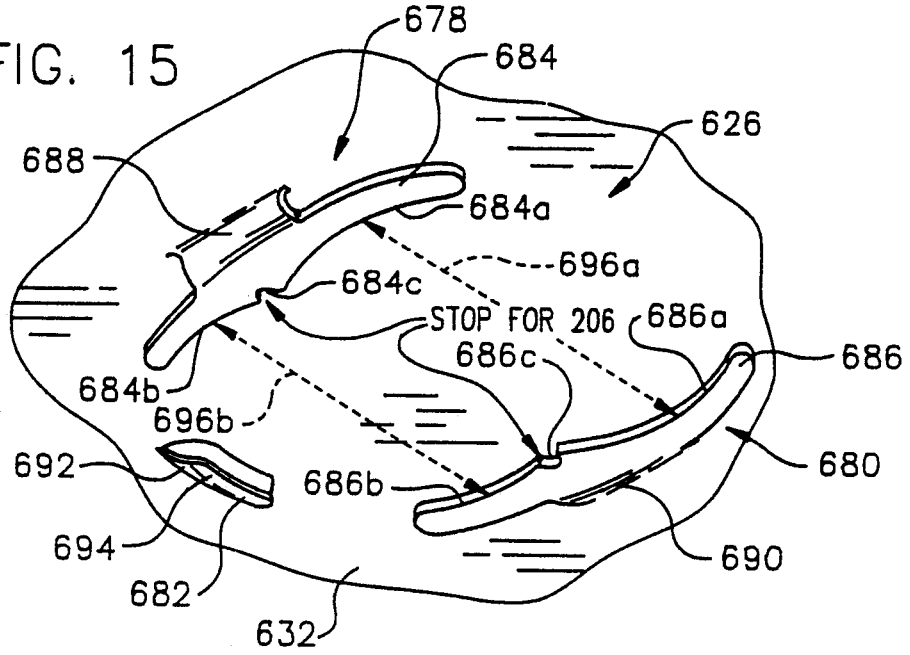

A glass holder of yet another plate-and-glass assembly that accommodates beverage containers of various diameters is depicted at 626 in FIGS. 15 and 16. The assembly partially depicted in FIG. 15 is similar in construction and assembly to the assembly 20 described above.

The glass holder 626 comprises first and second elongate tabs 678 and 680 and a short tab 682. The elongate tabs comprise rail portions 684 and 686 and bridge portions 688 an 690. The short tab 682 comprises a first portion 692 that extends downwardly from the bottom surface 632 and a second portion 694 that inwardly extends from the lower end of the first portion 692.

Formed on the rail portions 684 and 686 are curved surfaces **684*a,b* and 686*a,b*. A first container receiving area 696*a* is defined between the surfaces 684*a* and 686*a*, and a first container receiving area 696*b* is defined between the surfaces 684*b* and 686*b*. Stop notches 684*c* and 686*c* are also formed on the rails 684 and 686** for reasons which will be described below.

The curved surfaces **684*a* and 686*a* form a part of a first circle having a diameter slightly larger than that of a first beverage 624*a* can at the rim portion thereof. Similarly, the curved surfaces 684*b* and 686*b* form a part of a second circle having a diameter slightly larger than that of a second beverage can 624*b* at the rim portion thereof. In the exemplary glass holder 626, as shown in FIG. 16, the diameter of the first circle is greater than that of the second circle, allowing a relatively larger beverage can (e.g., size 206) 624*a* to be affixed to the lower surface 632 in the first receiving area and a relatively smaller beverage can (e.g., size 204) 624*b* to be affixed to the lower surface 632** in the second receiving area.

More particularly, if the smaller beverage can **624*b* is inserted between the rails 684 and 686 and the bottom surface 632, the can 624*b* is able to pass between the stop notches 684*c* and 686*c* and enter the and 686 must deflect slightly outwardly to allow passage of a smaller can 624*b* into the receiving area 696*b*. The short tab 682 stops the smaller can 624*b* to hold the can 624*b* in the receiving area 696*b***.

On the other hand, if a relatively larger can **624*a* is inserted between the rails 684 and 686 and can 624*a* is such that the can 624*a* cannot pass by the stop notches 684*c* and 686*c*; the relatively larger can 624*a* is thus firmly held in the first receiving area 696*a***.

Figure 17:
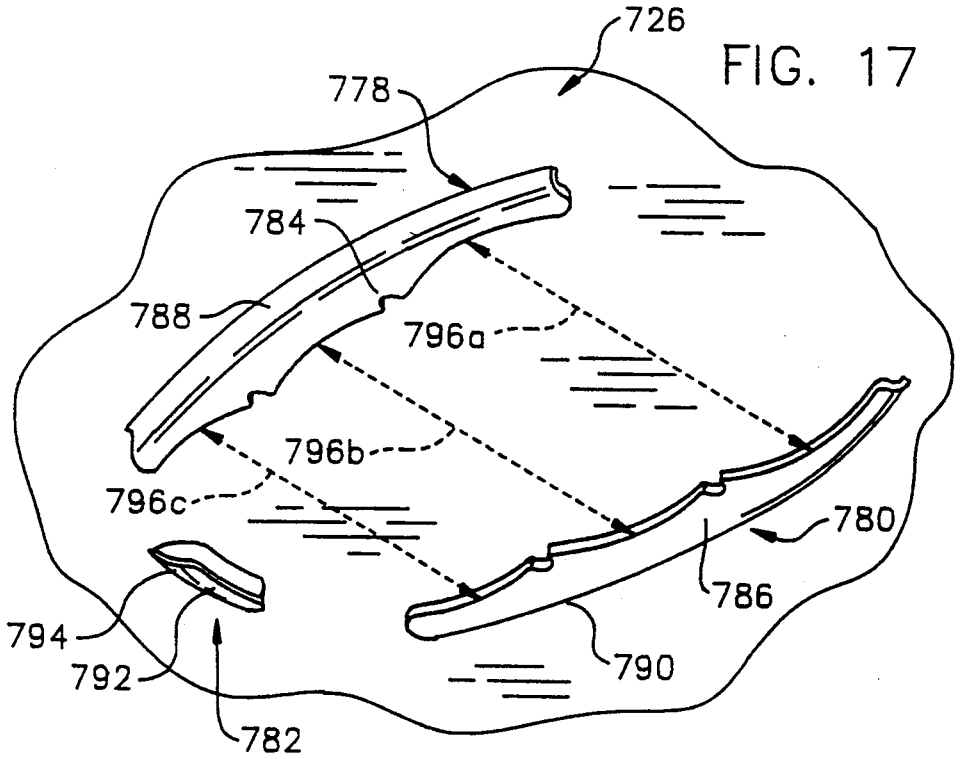

Another exemplary glass holder 726 shown in FIGS. 17 and 18 is essentially the same as the holder 626 except that the holder 726 is designed to accommodate three different can sizes: **724*a*, 724*b*, and 724*c*. Defined between rails 784 and 786 are three receiving areas 796*a*, 796*b*, and 796*c* basically the same as the receiving areas 696*a* and 696*b*. These cans 724*a*, 724*b*, and 724*c* could, for example, correspond to can sizes 206, 204, and 202** described above.

As is generally depicted in FIGS. 16 and 18, the rails 684, 686, 784, and 786 extend into recesses and abut lips in the beverage cans in the same basic manner depicted in, for example, FIGS. 13A and 13B.

Another consideration when implementing the glass holders 626 and 726 is the exact placement of these holders on the bottom surfaces 632 and 732. Specifically, at least one of the container receiving areas must be located off-center, creating a potentially unstable situation if the plate-and-glass assembly is set down. This minor problem can be alleviated by arranging the receiving area sized to accept the most commonly available beverage can so that it is centrally arranged on the bottom surface. Thus, in the majority of cases, the location of the container relative to the plate will not cause instability.

Conclusion

From the foregoing, it should be clear that the present invention may be embodied in many forms without departing from the spirit or essential characteristics of the invention.

For example, caps such as the caps 378, 478*a*, and 478*b* may also be designed to adapt styles of beverage containers other than those shown, such as the can 24 of the plate-and-glass assembly 20, to a generic size glass holder.

In another situation, it may be appropriate to provide a radially extending slot such as the slot 394 of the assembly 320 to caps such as the caps 478*a* and 478*b* of the assembly 420.

Another aspect of the invention is that it could easily be adapted for use as a frisbee-like flying disc.

An enormous number of variations and permutations of the features disclosed are thus possible. The above-described embodiments are therefore to be considered in all respects as illustrative and not restrictive, the scope of the invention being indicated by the appended claims rather than by the foregoing description; all changes which come within the meaning and range of equivalency of the claims are therefore intended to be embraced therein.

What is claimed is:

1. A plate-and-beverage container assembly comprising:

a. a plate assembly having:

i. a plate with a food-receiving surface and a lower side;

ii. a plate holder having a plate-receiving surface and a lower side, where the plate is received on the plate receiving surface of the plate holder to form the plate assembly;

b. a beverage container with a radial lip at an upper end thereof; and c. a beverage container holder on the lower side of the plate;

wherein the beverage container holder and the plate holder cooperate to allow relative radial sliding displacement of the beverage container relative to the plate and the beverage container holder having means so engageable with the lip on the container as to trap the lip against the lower side of the plate holder as the container is displaced relative to the plate and thereby so couple the container to the plate that the upper end of the container is covered by the plate holder and the container is in an upright orientation when the plate is horizontally oriented.

2. A plate-and-beverage container assembly as defined in claim 1, in which:

a. the plate has a rim having a peripheral configuration; and b. the plate holder has a rim with a peripheral configuration contoured to complement the peripheral configuration of the plate in a manner that inhibits lateral movement of the plate relative to the plate holder when the plate is received and supported by the plate holder.

3. A plate-and-beverage container assembly as defined in claim 1, in which:

a. the plate has a rim; and b. the plate holder has a rim and projections so extending therefrom that the projections engage the rim of the plate to inhibit upward movement of the plate relative to the plate holder.

4. A plate-and-beverage container assembly as defined in claim 1, in which the beverage container holder is formed from the plate holder in a manner that leaves at least one hole in the plate holder.

5. A plate-and-beverage container assembly as defined in claim 4, in which the beverage container holder comprises an array of tabs each having a downwardly extending first portion and a second portion radially extending inwardly from the first portion, where the tabs are so dimensioned and arranged that the second portions engage the lip to couple the container to the plate holder.

6. A plate-and-beverage container assembly as defined in claim 4, in which the beverage container holder comprises an arcuate flange so dimensioned and arranged that a radially inwardly extending portion thereof engages the lip to couple the container to the plate holder.

7. A plate-and-beverage can assembly comprising:

a. a plate means for receiving food having a food-receiving surface and a lower side;

b. a beverage can with a radial lip at an upper end thereof; and c. a can holder on the lower side of the plate;

wherein the can holder and the plate means cooperate to allow relative radial sliding displacement of the can relative to the plate means and the can holder having means so engageable with the lip on the can as to trap the lip against the lower side of the plate means as the can is displaced relative to the plate means and thereby so couple the can to the plate means that the upper end of the can is covered by the plate means and the can is in an upright orientation when the plate means is horizontally oriented.

8. A plate-and-beverage can assembly as defined in claim 7, in which the can holder comprises an array of tabs each having a downwardly extending first portion and a second portion radially extending inwardly from the first portion, where the tabs are so dimensioned and arranged that the second portions engage the lip to couple the can to the plate holder.

9. A plate-and-beverage can assembly as defined in claim 7, in which the can holder comprises an attachment plate and an array of wedges, where the attachment plate is attached to the plate holder and the wedges are so dimensioned and arranged on the attachment plate that the wedges engage the lip to couple the can to the plate holder.

10. A plate-and-beverage container assembly comprising:

a. a plate means for receiving food, the plate means having a food-receiving surface and a lower side;

b. a first beverage container having a first cap with a radial rim, the first cap being adapted to cover an upper end of the first container;

c. a second beverage container having a second cap with a radial rim, the second cap being adapted to cover an upper end of the second container; and d. a beverage container holder on the lower side of the plate;

wherein the beverage container holder and the plate means cooperate to allow relative radial sliding displacement of one of the first and second caps relative to the plate means and the beverage container holder has means so engageable with the rims on one of the first and second caps as to trap the rims against the lower side of the plate assembly as the caps are displaced relative to the plate means and thereby so couple the containers to the plate means that the upper ends of the containers are covered by the plate means and the containers are in an upright orientation when the plate means is horizontally oriented.

11. A plate-and-beverage container assembly as defined in claim 10 in which:

a. during transportation of the plate-and-glass beverage container assembly, the first beverage container is placed within the second beverage container and the beverage container holder engages the second cap to couple the second container to the plate means; and b. during use of the plate-and-glass assembly, the beverage container holder engages the first cap to couple the first container to the plate means.

12. A plate-and-beverage container assembly comprising:

a. a plate means for receiving food having a food-receiving surface and a lower side;

b. a beverage container having an upper end at which beverage may be drunk from the container;

c. a cap having a lip adapted to be locked onto the upper end of the beverage container.

c. a beverage container holder on the lower side of the plate;

wherein the beverage container holder and the plate means cooperate to allow relative sliding displacement of the container and cap relative to the plate means and the beverage container holder having means so engageable with the lip on the cap as to trap the lip against the lower side of the plate means as the container and cap are displaced relative to the plate means and thereby so couple the container to the plate means that the upper end of the container is covered by the plate means and the container is in an upright orientation when the plate means is horizontally oriented.

13. A plate-and-beverage container assembly as defined in claim 12, in which:

a. an orifice is provided in the cap to allow access to the interior of the beverage container; and b. a slot is provided in the cap which so accommodates a straw that the straw resides in a passageway formed by the walls of the slot and the lower side of the plate means.

14. A plate-and-beverage container assembly as defined in claim 13, in which:

a. the glass holder comprises at least one tab for engaging the lip on the can;

b. the cap may be so oriented relative to the beverage container holder that the at least one tab covers the slot in the cap.

15. A plate-and-beverage container assembly as defined in claim 14, in which a recess is formed in the cap under the lip, and the bottom surface of the slot is substantially coplanar with the bottom surface of the recess.

16. A plate-and-beverage container assembly as defined in claim 12, in which a coupling disc is formed on the cap, the coupling disc having a diameter appropriate for engaging portions of the glass holder to secure the cap to the plate means.

17. A plate-and-beverage container assembly comprising:

a. a plate means for receiving food, the plate means having a food-receiving surface and a lower side;

b. a first beverage container with a radial rim having a first diameter;

c. a second beverage container with a radial rim having a second diameter, the second diameter being greater than the first diameter; and d. a beverage container holder on the lower side of the plate;

wherein the beverage container holder and the plate means cooperate to allow relative radial sliding displacement of either of the first and second beverage containers relative to the plate means and the beverage container holder has means so engageable with the rims on either of the first and second beverage containers as to trap the rims against the lower side of the plate assembly as the caps are displaced relative to the plate means and thereby so couple either of the beverage containers to the plate means that the upper ends of the beverage containers are covered by the plate means and the beverage containers are in an upright orientation when the plate means is horizontally oriented.

18. A plate-and-beverage container assembly as recited in claim 17, in which the beverage container holder comprises first and second rails which extend from the lower side and which engage the rims of the beverage containers, where the rails are displaced to accommodate the rim of the second beverage container.

19. A plate-and-beverage container assembly as recited in claim 18, in which the beverage container holder comprises first and second rails which extend from the lower side and which engage the rims of the beverage containers, where the rails each comprise first and second surfaces, the first surfaces engaging the second beverage container and the second surfaces engaging the first beverage container.

* * * * *